US009359855B2

(12) United States Patent
Frazier

(10) Patent No.: US 9,359,855 B2
(45) **Date of Patent: *Jun. 7, 2016**

(54) BOTTOM SET DOWN HOLE TOOL

(71) Applicant: MAGNUM OIL TOOLS INTERNATIONAL, LTD., Corpus Christi, TX (US)

(72) Inventor: W. Lynn Frazier, Corpus Christi, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/624,150

(22) Filed: Feb. 17, 2015

(65) Prior Publication Data

US 2015/0159463 A1 Jun. 11, 2015

Related U.S. Application Data

(63) Continuation of application No. 13/953,185, filed on Jul. 29, 2013, now abandoned, which is a continuation of application No. 12/317,497, filed on Dec. 23, 2008, now Pat. No. 8,496,052.

(51) Int. Cl.
*E21B 33/12* (2006.01)
*E21B 23/06* (2006.01)
*E21B 33/134* (2006.01)

(52) U.S. Cl.
CPC ..... *E21B 33/12* (2013.01); *E21B 23/06* (2013.01); *E21B 33/134* (2013.01)

(58) Field of Classification Search
CPC . E21B 33/134; E21B 33/129; E21B 33/1294; E21B 33/1204; E21B 23/06
See application file for complete search history.

(56) References Cited

U.S. PATENT DOCUMENTS

| | | | | |
|---|---|---|---|---|
| 3,082,824 | A * | 3/1963 | Taylor | E21B 33/1293 166/123 |
| 4,437,516 | A | 3/1984 | Cockrell | |
| 4,595,052 | A | 6/1986 | Kristiansen | |
| 5,224,540 | A | 7/1993 | Streich et al. | |
| 6,708,768 | B2 | 3/2004 | Slup et al. | |
| 7,350,582 | B2 | 4/2008 | McKeachnie et al. | |

OTHER PUBLICATIONS

U.S. Appl. No. 11/644,443, filed Jul. 5, 2007, Douglas J. Lehr, etc.

(Continued)

*Primary Examiner* — Robert E Fuller

(57) ABSTRACT

A flow back plug, a bridge plug, a ball drop plug and plug with a disintegratable check therein are made from a common subassembly including, in some embodiments, a mandrel, a slips/seal section, a setting assembly and a mule shoe. In other embodiments, the common components are a mandrel, a slips/seal section and a mule shoe. To make the flow back plug, a ball check is placed in the mule shoe. To make the bridge plug, an obstruction is inserted in the mule shoe. To make the ball drop plug, the mule shoe is left unobstructed so any ball dropped in a well seats in a tapered inlet to the mandrel. To make a plug with a disintegratable check, a ball dropped in the well is of a type that disintegrated in frac liquids. The setting assembly includes a setting rod connected to a setting device in the mandrel passage. When the plug is expanded into sealing engagement with a production string, the setting rod pulls out of the setting device leaving a passage through the mandrel and through the setting device. Another embodiment is an improved adapter sleeve used on conventional setting tools.

9 Claims, 4 Drawing Sheets

(56) References Cited

OTHER PUBLICATIONS

Petition for Inter Parties Review for U.S. Pat. No. 8,079,413 (U.S. Appl. No. 13/194,871); Case No. 2013-00231; Filed Apr. 2, 2013; Administrative Patent Judge Sally C. Medley; Paper No. 31, Final Written Decision entered Sep. 2, 2014.

Petition for Inter Parties Review for U.S. Pat. No. 8,079,413 (U.S. Appl. No. 13/194,871); Case No. 2013-00231; Filed Apr. 2, 2013; Administrative Patent Judge Sally C. Medley; Paper No. 33, Decision on Request for Rehearing entered Oct. 29, 2014.

Petition for Inter Parties Review for U.S. Pat. No. 8,079,413 (U.S. Appl. No. 13/194,871); Case No. 2013-00231; Filed Apr. 2, 2013; Administrative Patent Judge Sally C. Medley; Paper No. 35, Notice of Appeal entered Dec. 23, 2014.

Petition for Inter Parties Review for U.S. Pat. No. 8,459,346 (U.S. Appl. No. 13/329,077); Case No. 2014-00993; Filed Jun. 19, 2014; Administrative Patent Judge Sally C. Medley; Paper No. 14, Decision to Institute Trial entered Dec. 1, 2014.

Petition for Inter Parties Review for U.S. Pat. No. 8,459,346 (U.S. Appl. No. 13/329,077); Case No. 2014-00993; Filed Jun. 19, 2014; Administrative Patent Judge Sally C. Medley; Paper No. 18, Termination of the Proceeding entered Dec. 11, 2014.

Petition for Inter Parties Review for U.S. Pat. No. 8,079,413 (U.S. Appl. No. 13/194,871); Case No. 2013-00231; Filed Oct. 4, 2013; Administrative Patent Judge Sally C. Medley; Paper No. 16, Final Written Decision entered Sep. 23, 2013.

*Magnum Oil Tools International, Ltd.* vs. *Tony D. McClinton, et al, etc.*, USDC Civ. Action No. 2:13-cv-00163; Filed Sep. 3, 2013; Plaintiff's First Amended Complaint and Application for Injunctive Relief.

*Magnum Oil Tools International, Ltd.* vs. *Tony D. McClinton, et al, etc.*, USDC Civ. Action No. 2:13-cv-00163; Filed Sep. 3, 2013; Patent Case—Scheduling Order.

* cited by examiner

BOTTOM SET DOWN HOLE TOOL

CROSS-REFERENCE TO RELATED APPLICATIONS

This application is a continuation of application Ser. No. 13/953,185 filed Jul. 29, 2013, which is incorporated hereby reference. Ser. No. 13/953,185 is a continuation of U.S. Pat. No. 8,496,052 having Ser. No. 12/317,497, filed on Dec. 23, 2008, which is incorporated by reference herein.

BACKGROUND OF THE INVENTION

An important development in natural gas production in recent decades, at least in the continental United States, has been the improvement of hydraulic fracturing techniques for stimulating production from previously uneconomically tight formations. For some years, the fastest growing segment of gas production has been from shales or very silty zones that previously have not been considered economic. The current areas of increasing activity include the Barnett Shale, the Haynesville Shale, the Fayetteville Shale, the Marcellus Shale and other shale or shaley formations.

There are a variety of down hole tools used in the completion and/or production of hydrocarbon wells such as bridge plugs, flow back plugs, ball drop plugs and the like. In the past, these have all been tools specially designed for a single purpose. It is no exaggeration to say that the future of natural gas production in the continental United States is from heretofore uneconomically tight gas bearing formations, many of which are shales or shaley silty zones. Accordingly, a development that allows effective frac jobs at overall lower costs is important.

Disclosures of interest relative to this invention are found in U.S. Pat. Nos. 2,714,932; 2,756,827; 3,282,342; 3,291,218; 3,393,743; 3,429,375; 3,554,280; 5,311,939; 5,419,399; 6,769,491; 7,021,389 and 7,350,582 along with printed patent application 2008/0060821.

SUMMARY OF THE INVENTION

In this invention, there is provided a common subassembly that can easily be assembled with specialty parts to provide a bridge plug, a flow back plug, a ball drop plug, or a plug having a disintegratable ball or plug check. Thus, a variety of down hole tools or plugs may be assembled from common subassembly parts and a few specialty parts that provide the special functions of different plugs. Thus, a supplier does not have to keep so much inventory because one always seems to receive orders for what is in short supply.

The subassembly parts that are common to the down hole plugs disclosed herein are, in some embodiments, a mandrel, the elements of a slips/seal section, a mule shoe and a setting assembly that, when the plug is manipulated by a conventional setting tool, expands the slips/seal section into sealing engagement with the inside of a production or pipe string. An important feature of this subassembly is that manipulating the tool to set the slips creates a passageway through the setting assembly and, in some embodiments, through the plug. This allows the assembly of a bridge plug, a flow back plug, a ball drop plug or a plug having a disintegratable valve simply by the addition of specialized parts.

In some embodiments, the common subassembly is a mandrel, the elements of a slips/seal section and a mule shoe. In these embodiments, the plug is expanded by pulling on the mandrel and/or pushing on the slips/seal section to expand the slips/seal section in a conventional manner. Another embodiment is an improved adapter sleeve used with conventional setting tools to set a plug having an expandable slips/seal section.

It is an object of this invention to provide an improved down hole well plug that is easily adapted to provide different functions.

A more specific object of this invention is to provide an improved down hole plug in which a setting rod is tensioned to set the plug on the inside of a production or pipe string and then pulled out of the plug.

These and other objects and advantages of this invention will become more apparent as this description proceeds, reference being made to the accompanying drawings and appended claims.

DETAILED DESCRIPTION

Figure 1:
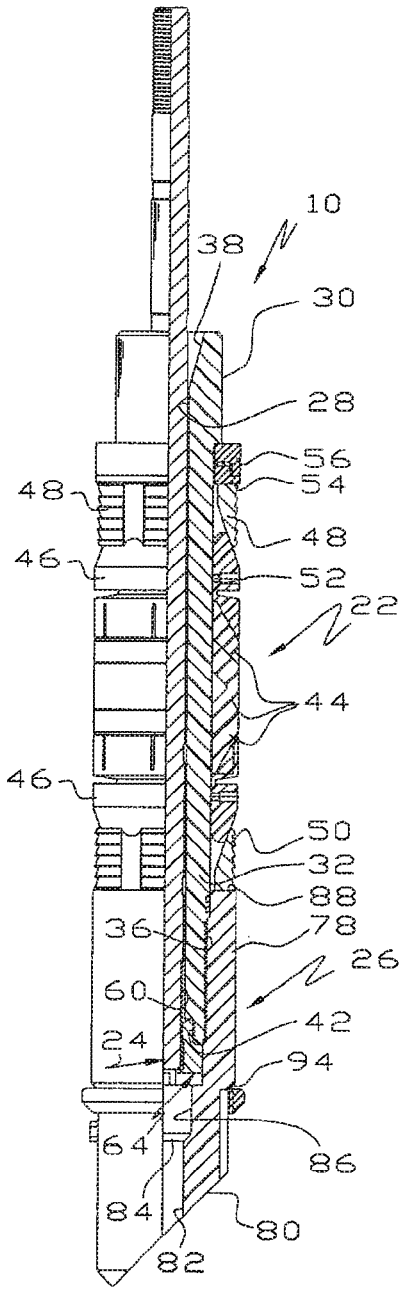
FIG. 1 is a cross-sectional view of a subassembly which is readily modified to act as a variety of tools and which also comprises a ball drop plug, illustrated in a running in or extended position.
Figure 2:
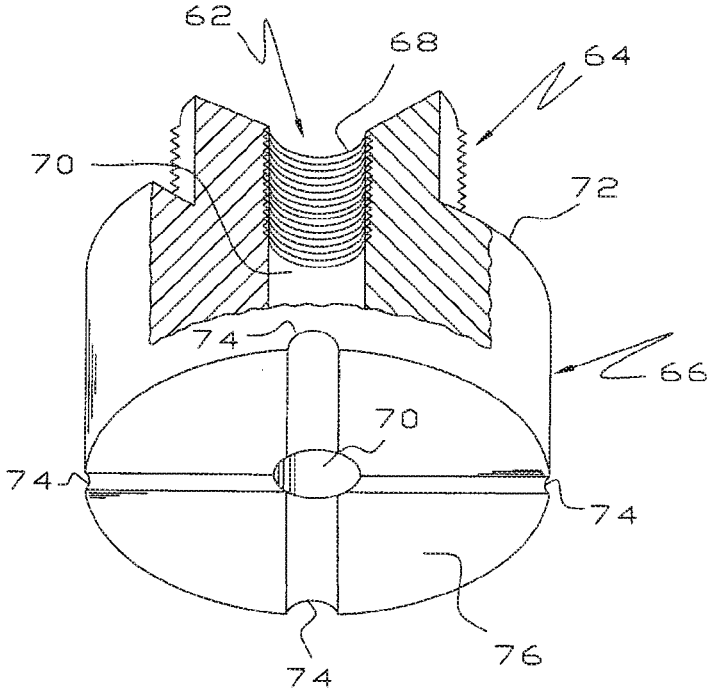
FIG. 2 is an enlarged isometric view, part of which is broken away for clarity of illustration, of a setting device used in the subassembly of FIG. 1.
Figure 3:
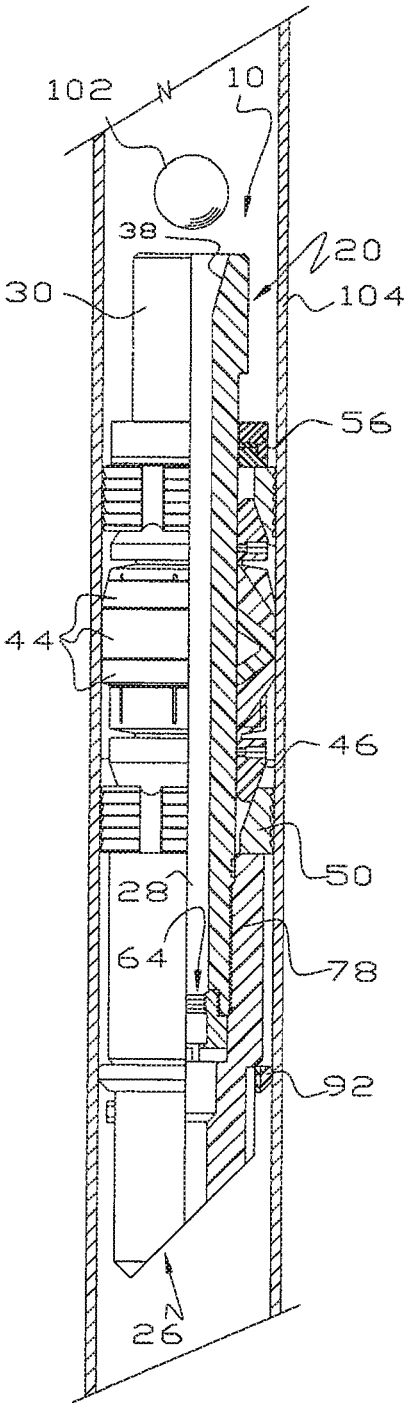
FIG. 3 is a cross-sectional view of the ball drop plug of FIG. 1, illustrated in a set or collapsed position.
Figure 4:
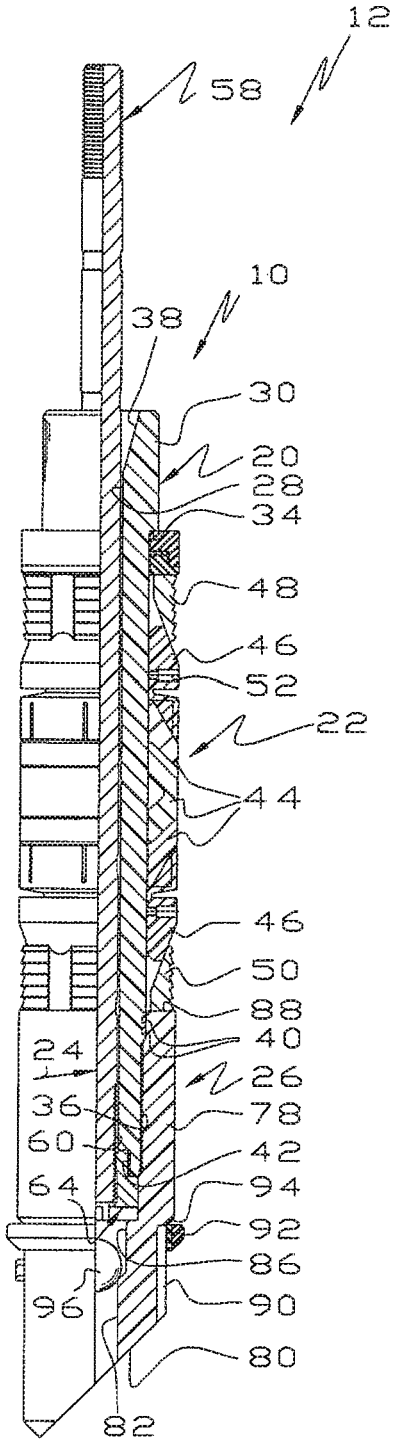
FIG. 4 is a cross-sectional view of a flow back tool, illustrated in a running in or extended position.
Figure 5:
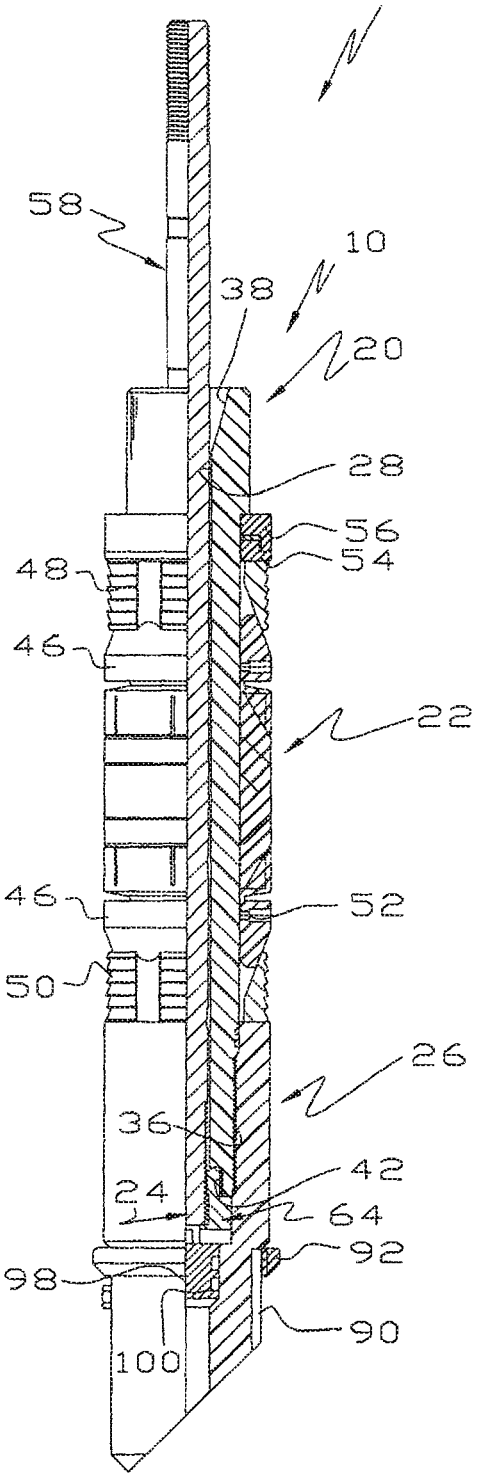
FIG. 5 is an enlarged cross-sectional view of a bridge plug, illustrated in a running in or extended position.

Referring to FIGS. 1-3, there is illustrated a subassembly 10 which is usable, without modification, as a ball drop plug and which may have a few components added to it to provide a flow back plug 12 shown in FIG. 4 or a bridge plug 14 as shown in FIG. 5. The subassembly or ball drop plug 10 comprises, as major components in some embodiments, substantially identical mandrels 20, substantially identical slips/seal sections or assemblies 22, substantially identical setting assemblies 24 and substantially identical mule shoes 26. Because it is often desired to drill out the plugs 10, 12, 14 the components left in the well are typically made of drillable materials, such as composite plastics, aluminum, bronze or other drillable materials. Composite plastics are well known in the art and comprise a fabric impregnated with a suitable resin and allowed to dry.

The mandrel 20 provides a central axial passage 28, an upper section 30 and an elongate lower section 32 separated from the upper section 30 by a shoulder 34. The words upper and lower are somewhat inaccurate because they refer to the position of the well tools as if they were in a vertical position while many, if not most, of the plugs disclosed herein will be used in horizontal wells. The words upper and lower are used for purposes of convenience rather than the more accurate, but odd to oil field hands, proximal and distal. The lower end 36 of the lower section 32 is threaded for connection to the mule shoe 26 as will be more fully apparent hereinafter. In some embodiments, the exterior of the lower section 32 is smooth so the slips/seal section or assembly 22 slides easily on it. The passage 28 includes a tapered inlet 38 providing a ball seat for purposes more fully apparent hereinafter. One or more seals 40 can be provided to seal between the mandrel 20 and the mule shoe 26 as is customary in the art. The terminus of the mandrel 20 includes a rabbit or annular notch 42 to receive part of the setting assembly 24 as also will be apparent hereinafter.

The slips/seal section 22 is more-or-less conventional and provides one or more resilient seals 44 and one or more wedge shaped elements 46 which abut wedge shaped slips 48, 50 having wickers or teeth. The elements 46 are conveniently pinned to the mandrel lower section 32 by plastic bolts or pins 52 so the seals 44 and elements 46 stay in place during handling. The plastic bolts 52 are easily sheared during setting of the plugs 10, 12, 14. The upper slips 48 abut a pair of load rings 54, 56 while the lower slips 50 abut a square shoulder provided by the mule shoe 26.

The setting assembly 24 includes a setting rod 58 having a lower threaded end 60 received in a passage 62 provided by a setting device 64. Because the setting rod 58 is removed from the well, in most embodiments it is normally not made of a drillable material and is typically of steel. As most apparent from FIG. 2, the setting device 64 includes a body 66 through which the passage 62 extends completely. The passage 62 has a threaded upper end 68 and a slightly larger lower end 70 which, in some embodiments, is conveniently not threaded. In most embodiments, the threaded end 68 is considerably shorter than the unthreaded lower end 70. The setting device 64 includes a shoulder 72 sized to be received in the rabbit 42 and a series of radiating channels 74 in the bottom wall 76, which have a function in the flow back plug 12 shown in FIG. 4. The setting device 64 is made of a drillable material, usually a metal such as aluminum, brass or bronze.

When setting the plugs 10, 12, 14 the setting tool (not shown) pulls on the setting rod 58 and pushes on the slips/seal section 22 to expand the seals 44 and set the slips 48, 50 against a production or pipe string in the well. It is necessary to pull the rod 58 completely out of the mandrel passage 28 and it is desirable that the rod 58 pullout of the mandrel 20 in response to a predictable force. To this end, the number of threads on the setting rod 50 and/or in the setting device 64 is limited. In other words, if six rounds of threads produce a device having the desired tensile strength, then the threaded end 60 and/or the threaded passage section 62 is made with only six threads. In the alternative, it will be apparent that the rod 58 can be connected to the device 64 in other suitable ways, as by the use of shear pins or the like or the rod 58 can be connected using other releasable techniques to the mandrel 20.

The mule shoe 26 comprises the lower end of the subassembly 10 and includes a body 78 having a tapered lower end 80 and a passage 82 opening through the lower end 80. The passage 82 includes a valve seat 84 which is the lower end of a chamber 86 housing a ball check in the flow back plug 12 of FIG. 4 or an obstruction in the case of the bridge plug 14 of FIG. 5. The mule shoe 26 includes an upper end 88 abutting the bottom of the lower slip 50 and a series of grooves 90 which allow completion fluids to pass more readily around the mule shoe 26 at appropriate times, for example when the plug is being pulled by a wireline upwardly in a liquid filled well. A pump down collar 92 slips over the lower end of the mule shoe 26 and abuts a shoulder 94 so the plug may be pumped into a horizontal leg of a well.

No special components need to be added to the subassembly 10 to provide the ball drop plug. In other words, the ball drop plug 20 and the subassembly 10 are identical. However, in order for the ball drop plug 10 to operate, a ball check 102 is dropped into a production or pipe string 104 to seat against the tapered inlet 38. Those skilled in the art will recognize that the ball drop plug 10 can be used in a situation where a series of zones are to be fraced. There are a number of ways that ball drop plugs are conventionally used, one of which is to frac a zone, run a ball drop plug into the well above the fraced zone, drop a ball 102 into the production string 104 and thereby isolate the lower zone so a higher zone may be fraced.

In order to assemble the flow back plug 12 from the subassembly 10, it is necessary only to insert a ball check 96 into the chamber 86 as the plug 12 is being assembled. It will be apparent to those skilled in the art that the flow back plug 12 is often used in situations where a series of zones are to be fraced in a well. After a zone is fraced, the flow back plug 12 is run into the well and expanded against a production string. The ball check 96 prevents flow through the plug 12 is a downward direction in a vertical well but allows the fraced zone to produce up the production string.

In order to assemble the bridge plug 14, it is necessary only to insert an obstruction 98 into the chamber 86 as the plug 14 is being assembled. In some embodiments, the obstruction 98 includes o-rings or other seals 100 engaging the inside of the chamber 86. It will be seen to those skilled in the art that the bridge plug 14 prevents flow, in either direction, through the plug 14 so the plug 14 is used in any situation where bridge plugs are commonly used.

It will be apparent that the ball check 98 or the ball check 102 may be made of a disintegratable material so the check valve action of these plugs is eliminated over time.

As shown best in FIG. 3, in operation, a conventional setting tool (not shown) such as a Model 10, 20 or E-4 Setting Tool available from Baker oil Tools, Inc., Houston, Tex., and appropriate connector subs are attached to the setting rod 58 of the plug being set and an annular member rides over the upper section 30 of the mandrel 20 to abut the load ring 56, which is the uppermost component of the slips/seat section 22. When this assembly has been lowered to the desired location in a vertical well or pumped to the desired location in a horizontal well, the setting tool is actuated to tension the rod 58 and/or compress the load ring 56. This shears off the plastic screws 52 so the slips 48, 50 slide toward each other on the exterior of the mandrel 20. This forces the resilient seals 44 outwardly to seal against the inside of the production string 104 and expands the slips 48, 50 so the withers grip the inside of the production string 104 and set the plug in place. Continued pulling on the rod 58 shears off the threads 68 between the rod 58 and the device 64 thereby releasing the rod 58 which is withdrawn from the mandrel 20. This leaves a passage through the mandrel 20 and through the device 64. This feature allows the subassembly 10 to be used without modification as a ball drop plug, to be configured as the flow back plug 12 of FIG. 4 or the bridge plug 14 of FIG. 5.

It will be apparent that the subassembly 10 may be shipped to a customer along with a container including the ball check 96 and the obstruction 98 so the plug needed may be assembled in the field by a wire line operator.

Figure 6:
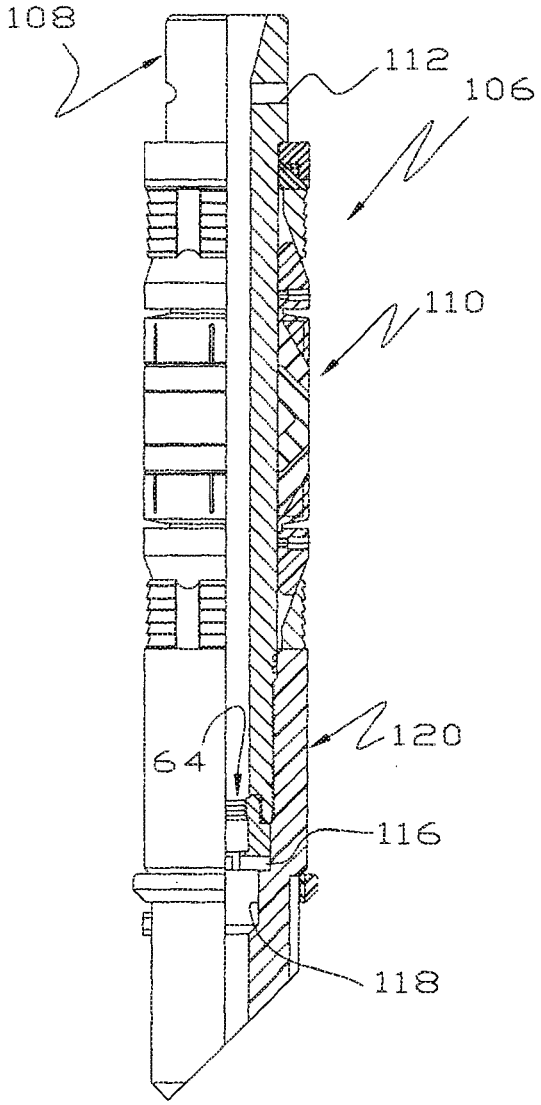
FIG. 6 is a cross-sectional view of another embodiment of a subassembly used to provide a ball drop plug, a bridge plug and/or a flow back plug.

Referring to FIG. 6, another embodiment 106 which serves as a ball drop plug and which can readily be modified to provide a bridge plug or flow back plug. As illustrated, the subassembly 106 differs from the subassembly 10 mainly in a different technique for expanding the plug. More specifically, the subassembly 106 is set by pulling on the mandrel 108 and/or pushing on the slips/seal section 110. This has several consequences, one of which is that the mandrel 108 provides one or more passages 112 for receiving a shear pin (not shown) for connecting the mandrel 108 to the setting tool (not shown). The mandrel 108 is preferably made of aluminum or other strong drillable metal so it can withstand the forces involved in setting the plug 106.

The setting device 114 no longer acts as a setting device and thus no longer requires threads but acts to provide a function in both the flow back plug version and the bridge plug version of FIG. 6. The device 114 acts as a lip for retaining a ball check where the subassembly 106 has been converted into a flow back plug analogous to FIG. 4 or an obstruction where the subassembly has been converted into a bridge plug analogous to FIG. 5. The bypass channels 116 act to allow fluid flow around a ball check placed in the chamber 118 so upward flow is allowed. It will be seen that the device 114 need not be a separate component but may comprise part of the lower end of the mandrel 108.

It will be seen that the subassembly 106 provides a mule shoe 120 which is threaded onto the mandrel 108 so a ball check analogous to the ball check 96 may be placed in the chamber 118 during assembly to convert the subassembly 106 into a flow back plug. Similarly, the removable mule shoe 120 allows an obstruction analogous to the obstruction 98 may be placed in the chamber 118 during assembly to convert the subassembly 106 into a bridge plug. Other than the technique by which the subassembly 106 is expanded, it operates in substantially the same manner as the subassembly 10.

The subassembly 106 is set in a conventional manner, i.e. a setting tool connects to the mandrel 108 through the shear pins (not shown) extending through the passage 112. As the mandrel 108 is tensioned and the slips/seal section 110 is compressed, the plug expands into sealing engagement with the production or pipe string. When sufficient force is applied, the shear pins fail thereby releasing the setting tool so it can be pulled from the well.

It will be seen that the subassembly 10 has the advantage of providing a composite plastic mandrel 20 which is less expensive and easier to drill up than the stronger mandrel 106 of FIG. 6. It will be seen that the subassembly 106 has the advantage of using conventional shear pins and a conventional manner of expanding the plugs.

Figure 7:
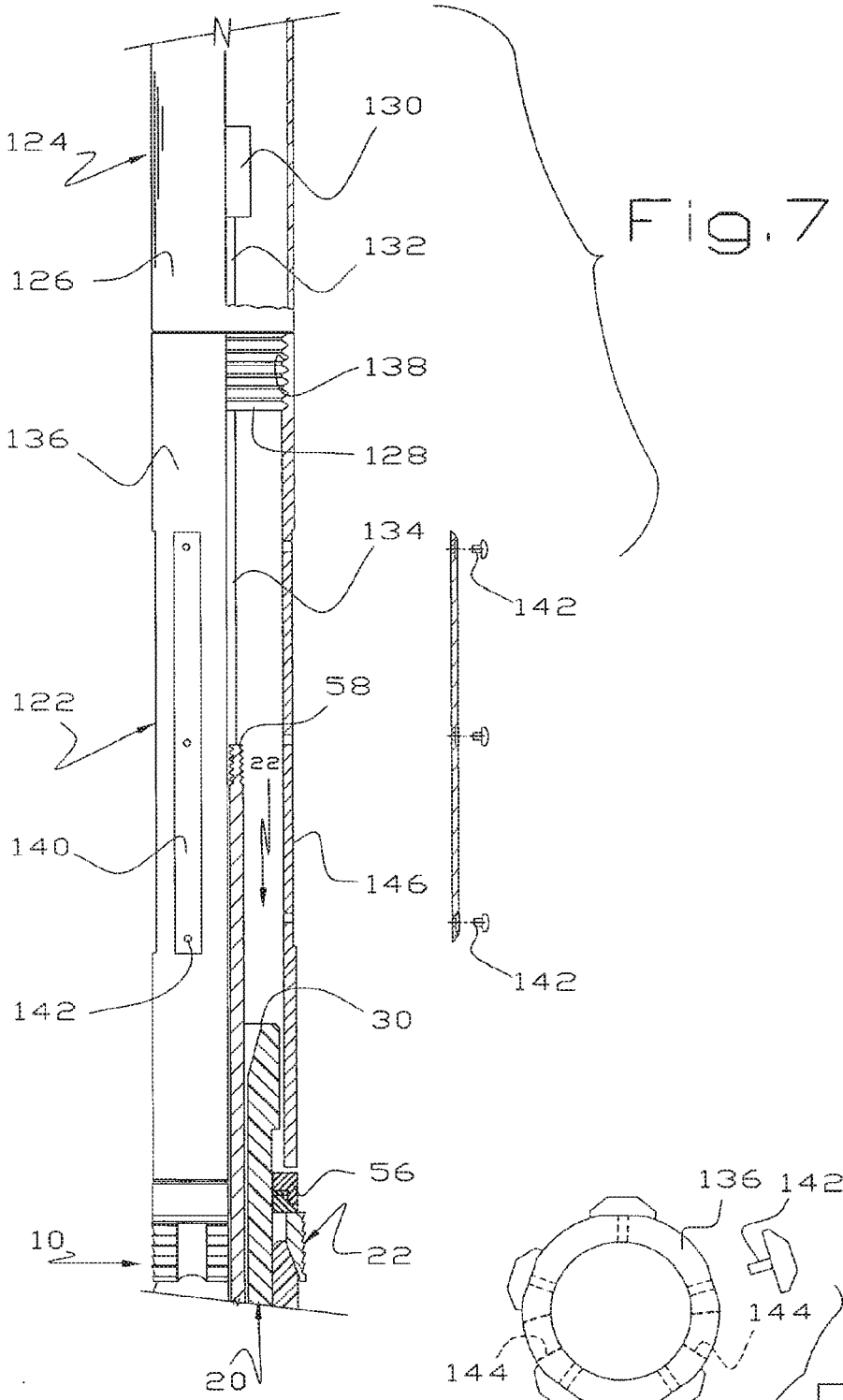
FIG. 7 is an exploded view, partly in section, of an improved adapter or sleeve used in conjunction with a conventional setting tool.
Figure 8:
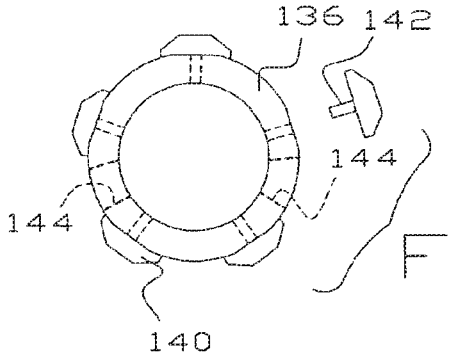
FIG. 8 is an end view of the adapter of FIG. 7.

Referring to FIGS. 7-8, there is illustrated an improved adapter 122 on the bottom of a commercially available setting tool 124. The setting tool may be of any suitable type such as an Owen Oil Tools wireline pressure setting tool or a Model E-4 Baker Oil Tools wireline pressure setting assembly. These setting tools are typically run on a wireline and include a housing 126 having male threads 128 on the lower end thereof and an internal force applying mechanism 130 which is typically a gas operated cylinder powered by combustion products from an ignition source and includes a terminal or connection 132.

The diameter and other dimensions of plugs made by different manufacturers vary but must adapt, in some manner, to conventional setting tools. Accordingly, plug manufacturers provide an internal adapter 134 for connection to the terminal 132 for applying tension to the plug and an external adapter, such as the adapter 122, for resisting upward or tension induced movement of the slips/seal section of the plug. This results, conventionally, in tension being applied to the mandrel of the plug and/or compression to the slips assembly. The internal adapter 134 connects between the terminal 132 and the setting rod 58, in the embodiments of FIGS. 1-5 or between the terminal 132 and the mandrel 108 of FIG. 6.

The adapter 122 comprises a sleeve 136 having threads 138 mating with the threads 128 thereby connecting the sleeve 136 to the setting tool 124. The lower end of the sleeve 136 rides over the O.D. of the upper mandrel end 30 of the plug 22 and abuts, or nearly abuts, the upper load ring 56. When the force applying mechanism 130 is actuated, the adapter 134 pulls upwardly on the setting rod 58 while the sleeve 136 prevents upward movement of the load ring 56 thereby moving the slips/seal section 22 relatively downwardly on the mandrel 20 and expanding the plug 10 into engagement with a production string into which the plug 10 has been run.

In some embodiments, the sleeve 136 includes a series of wear pads or centralizers 140 secured to the sleeve 134 in any suitable manner. One technique is to use threaded fasteners or rivets 142 captivating the centralizers 140 to the sleeve 136. In some embodiments, the centralizers 140 are elongate ribs although shorter button type devices are equally operative although more trouble to manufacture and install. In some embodiments, one or more viewing ports 144 may be provided to inspect the inside of the sleeve 136. In some embodiments, the sleeve 136 can be milled to provide a flat spot 146. In some embodiments, the base of the centralizers may be curved to fit the exterior of the sleeve 136.

In some embodiments, the centralizers 140 are made of a tough composite material such as a tough fabric embedded in a resin. In some embodiments, the fabric is woven from a para-aramid synthetic fiber such as KEVLAR manufactured by DuPont of Wilmington, Del. In use, the centralizers 140 increase the effective O.D. of the sleeve 136 or, viewed slightly differently, reduce the clearance between the O.D. of the sleeve 136 and the inside of the production string in which the plug 10 is run. This acts to center the sleeve 136 and the setting tool 124 in the production string and introduces a measure of consistency or uniformity in the setting of plugs. The force applied by the mechanism 130 is substantial, e.g. in excess of 25,000 pounds in some sizes, and it is desirable for the plug 10 to be centered in the production string.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

What is claimed is:

1. A plug for isolating a wellbore, comprising:

a body having a first end and a second end, wherein:

the body is adapted to receive an impediment that restricts fluid flow in at least one direction through the body;

the body is made from one or more composite materials;

at least one sealing element disposed about the body;

at least one slip disposed about the body;

at least one conical member disposed about the body;

a head member disposed proximate the second end of the body, the head member having a tapered end;

an insert at least partially disposed within the body proximate the second end of the body, wherein:

the insert is adapted to receive a setting tool that enters the body through the first end of the body;

the insert comprises one or more shearable threads disposed on an inner surface thereof;

the one or more shearable threads are adapted to engage the setting tool;

the one or more shearable threads are adapted to release the setting tool when exposed to a predetermined axial force;

the insert comprises a shoulder disposed on an outer surface thereof, the shoulder adapted to abut the second end of the body; and the insert is made of a material selected from the group consisting of aluminum, brass, and bronze.

2. The plug of claim 1, wherein the body is a mandrel.

3. The plug of claim 1, wherein the impediment restricts fluid flow in both directions.

4. The plug of claim 1, wherein the impediment is disposed at least partially within the insert.

5. The plug of claim 1, wherein the impediment is a ball.

6. The plug of claim 1, wherein the impediment is disposed proximate the first end of the body.

7. The plug of claim 1, further comprising a tapered surface disposed on or proximate the first end of the body, wherein the tapered surface is designed to contact and engage a tapered end of the head member of a superposed plug to lockup, thereby preventing or reducing relative rotation there between.

8. The plug of claim 1, wherein the impediment is at least partially disposed within the head member.

9. The plug of claim 1, wherein the predetermined axial force to release the setting tool is less than an axial force required to break the body.

* * * * *